US006803892B2

(12) United States Patent
Roh et al.

(10) Patent No.: US 6,803,892 B2
(45) Date of Patent: Oct. 12, 2004

(54) APPARATUS AND METHOD FOR CONTROLLING AUTOMATIC ADJUSTMENT OF POWER SUPPLY OF DISPLAY PANEL DRIVING SYSTEM

(75) Inventors: Chung-wook Ro Roh, Seoul (KR); Chang-wan Hong, Suwon-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/388,175

(22) Filed: Mar. 14, 2003

(65) Prior Publication Data

US 2003/0218431 A1 Nov. 27, 2003

(30) Foreign Application Priority Data

Apr. 2, 2002 (KR) ..... 2002-18018

(51) Int. Cl.[7] ..... G09G 3/36
(52) U.S. Cl. ..... 345/87; 345/76
(58) Field of Search ..... 345/73–77, 87–89; 315/169.1–169.4; 348/189–191

(56) References Cited

U.S. PATENT DOCUMENTS 5,793,344 A * 8/1998 Koyama ..... 345/87
5,880,710 A * 3/1999 Jaberi et al. ..... 345/117
6,498,592 B1 * 12/2002 Matthies ..... 345/76

* cited by examiner

*Primary Examiner*—Wilson Lee
(74) *Attorney, Agent, or Firm*—Sughrue Mion, PLLC

(57) ABSTRACT

An apparatus and method for controlling automatic adjustment of a power supply of a display panel driving system. According to the apparatus and method, a voltage of the power supply of the display panel driving system is automatically adjusted in order to have the best possible image quality. According to the apparatus and method, since the PDP driving power supply is not manually adjusted using the variable resistors as in the related art, but is automatically adjusted. The apparatus manufacturing process is simple, and deviation caused by the automatic adjustment of the power supply is decreased compared with the manual adjustment of the related art, by automatically adjusting the PDP driving voltage affecting to the contrast deviation and brightness deviation of the PDP image in the PDP driving power supply circuit so as to maintain the best possible image quality.

23 Claims, 5 Drawing Sheets

APPARATUS AND METHOD FOR CONTROLLING AUTOMATIC ADJUSTMENT OF POWER SUPPLY OF DISPLAY PANEL DRIVING SYSTEM

BACKGROUND OF THE INVENTION

This application claims priority to Korean Patent Application No. 2002-18018, filed Apr. 2, 2002, which is incorporated herein in its entirety by reference.

1. Field of the Invention

The present invention relates to an apparatus and method for controlling a power supply of a display panel driving system, and more particularly, to an apparatus and method for controlling automatic adjustment of a power supply of a display panel driving system, by automatically adjusting a voltage of the power supply of the display panel driving system to have an optimal image quality based on a sensed image state.

2. Description of the Related Art

As shown in FIG. 1, a related art general plasma display panel driving system includes a scan electrode driving board 110, a plasma display panel (PDP) 120, a common electrode driving board 130 and an address driver integrated circuit (IC) 140.

A driving sequence of the related art PDP 120 is divided into a reset period, a scan period and a sustain period, which are repeated. In the reset period, a display hysteresis is removed by discharging all cells and simultaneously eliminating wall charges. In the scan period, the cells are selected by matrix configuration due to a combination of raw electrodes and column electrodes so that an address discharge is formed. In the sustain period, an image is displayed while repeatedly charging and discharging the cells, which are selected in the scan period, using an energy recovery process.

A driving sequence comprised of respective operation periods of a PDP driving system is disclosed in, U.S. Pat. No. 4,866,349.

As shown in FIG. 2, stable direct current (DC) voltages such as a sustain circuit driving voltage Vs (160–190V DC), a reset circuit driving voltage Vset (200–230V DC) of the scan electrode driving board 110, a bias circuit driving voltage Ve (180–200V DC) of the common electrode driving board 130, a scan circuit voltage Vscan (60–80V DC) and an address circuit voltage Va (60–80V DC) are supplied to the PDP driving system by a general panel power supply circuit including a rectifying circuit 210 and a plurality of DC/DC converters 220-1 to 220-6, so that the above-described driving sequence comprised of the respective operation periods of the PDP driving system is performed.

Changes in the voltages supplied to the PDP driving system directly affect the contrast and brightness of an image, and thus the voltages must be controlled in consideration of a deviation of the panel performance.

According to the prior art, as shown in FIG. 3, supply voltage is manually adjusted by a control circuit for voltage adjustment including a general flyback DC/DC converter circuit. Since an output voltage $V_{s,sense}$ which is sensed at a point connecting a resistor R2 and a variable resistor VR1 though feedback control, follows a reference voltage Vref of an error amplifier 30-2, the voltage Vs,sense satisfies Equation 1:

$$V_{s,sense} = \frac{R_2}{R_1 + R_2} V_s \approx V_{ref} \tag{1}$$

$$V_2 = \left(1 + \frac{R_1}{R_2}\right) V_{ref}$$

In Equation 1, R1 is a resistance value of the variable resistor $VR_1$. It can be seen from Equation 1 that a driving voltage Vs of the panel varies according to the resistance value $R_1$ of the variable resistor $VR_1$.

Conventionally, the various driving voltages, for example, Vs, Vset, Va and Ve, in a PDP set manufacturing process are manually adjusted using the variable resistor in the circuit as shown in FIG. 3, so that an image is adjusted to have the best possible image quality.

Thus, according to the prior art, there are problems in that, for example, a manufacturing process of the PDP driving system is complex. Also, it is difficult to accurately adjust an image during mass production by manually adjusting the driving voltages required by the PDP driving system using the variable resistor.

SUMMARY OF THE INVENTION

To solve the above-described problems, it is an object of the present invention to provide an apparatus and method for controlling automatic adjustment of a power supply of a display panel driving system, in order to automatically adjust driving voltages of a display panel by sensing contrast information and brightness information, which are affected by changes in the driving power supply, and driving the plasma display panel to have the best possible image quality based on the sensed contrast information and brightness information.

According to an aspect of the present invention, an apparatus for automatically controlling automatic adjustment of a power supply of a display panel driving system comprises a look-up table which stores power supply control data for controlling a display panel driving power supply corresponding to predetermined image information; a sensor which senses the predetermined image information from an image signal output from the display panel; a control circuit which converts the image information sensed by the sensor into digital data, reads power supply control data corresponding to a value of the digital data of the image information from the look-up table, and generates a power supply control signal corresponding to the power supply control data; and a power supply adjusting circuit which automatically changes a predetermined voltage of the power supply supplied to a display panel driving circuit according to the power supply control signal.

According to another aspect of the present invention, a method for controlling a power supply of a display panel driving system comprises (a) sensing with a sensor predetermined image information from an image signal output from a display panel, (b) reading from a look-up table power supply control data corresponding to the sensed predetermined image information, (c) generating a pulse-width modified power supply control signal from the read power supply control data, and (d) controlling a display panel driving power supply according to the pulse-width modified power supply control signal.

Additionally, a computer-readable medium including a set of instructions is provided, wherein the instructions include (a) sensing with a sensor image information from an image signal output from a display panel, (b) reading from a look-up table power supply control data corresponding to the sensed image information, (c) generating a pulse-width modified power supply control signal from the read power supply control data, and (d) controlling a display panel driving power supply according to the pulse-width modified power supply control signal.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 4:
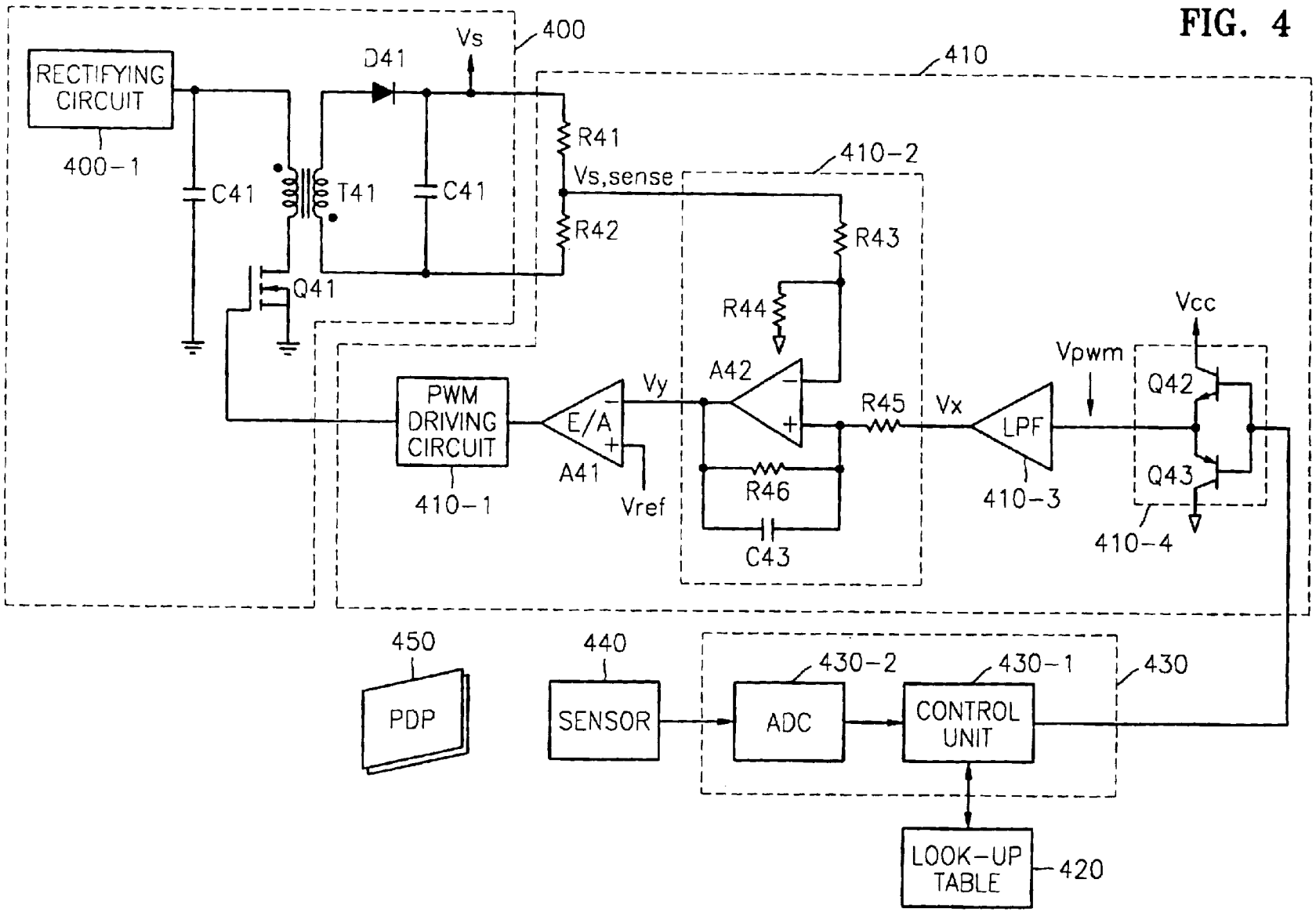
FIG. 4 is a configuration view of an apparatus for controlling automatic adjustment of a power supply of a display panel driving system according to a non-limiting, exemplary embodiment of the present invention.
Figure 5:
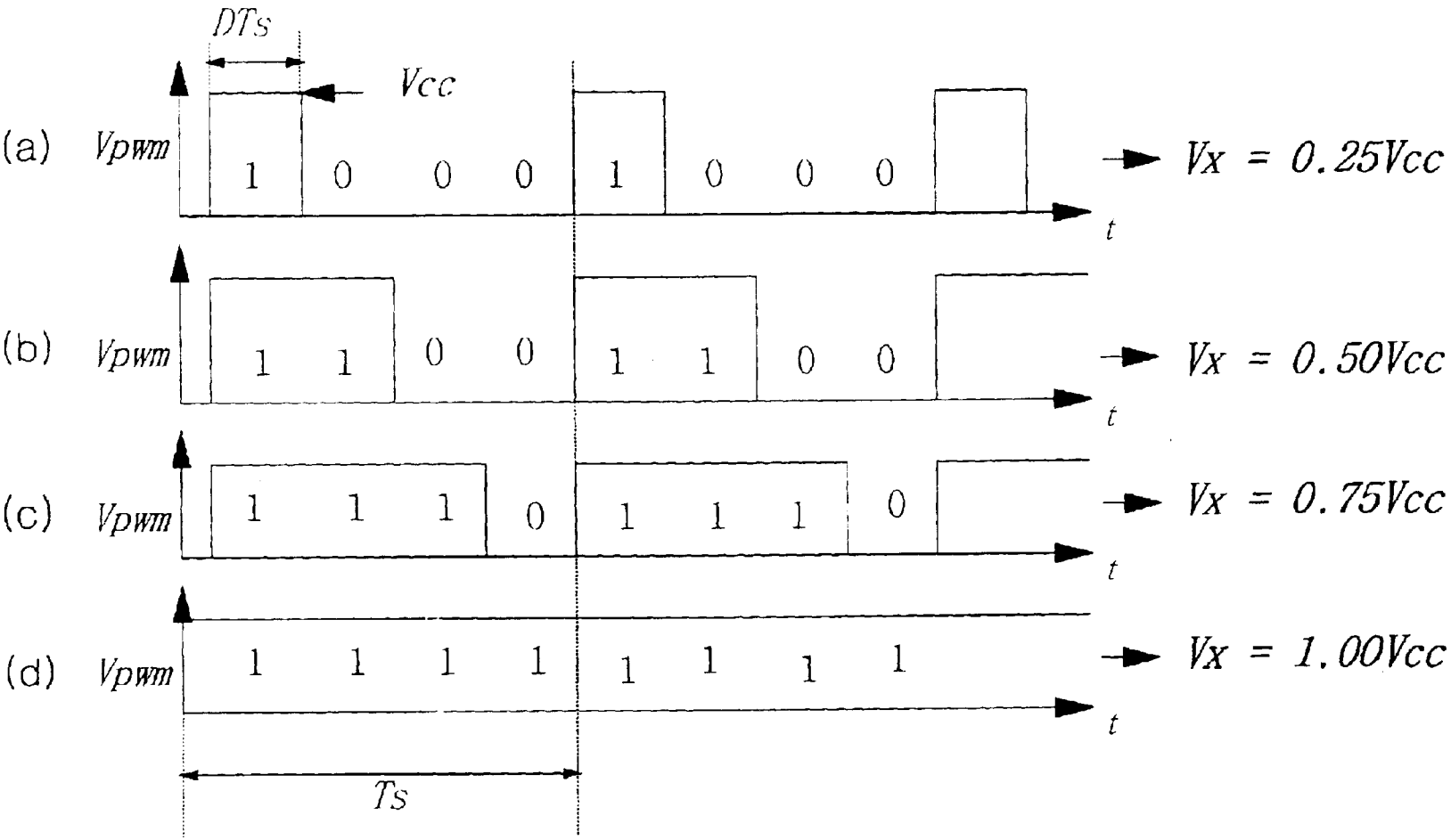
FIGS. 5A through 5D shows a relationship between voltages output by a low pass filter of FIG. 4 and power supply control data of according to a non-limiting, exemplary embodiment of the present invention.

As shown in FIG. 4, an apparatus for automatically adjusting a power supply of a display panel driving system according to the present invention includes a power supply circuit 400, a power adjusting circuit 410, a look-up table 420, a control circuit 430, a sensor 440 and a plasma display panel (PDP) 450.

The power supply circuit 400 includes a rectifying circuit 400-1 for converting an alternating current (AC) power supply into a direct current (DC) power supply, and a DC/DC converter circuit including a transformer T41, a diode D41, a capacitor C41, and a transistor Q41 for generating DC driving voltages required by a PDP driving circuit from a DC output voltage of the rectifying circuit 400-1.

The power adjusting circuit 410 includes a pulse width modulation driving unit 410-1, an error amplifier A41, a subtractor circuit 410-2, a low pass filter 410-3, a buffer circuit 410-4 and a voltage sensing circuit R41–R42.

Information stored in the look-up table 420 includes image information values affected by changes in the PDP driving voltages, and power supply control data controlling the PDP driving voltages corresponding to the image information values to have the best possible image quality.

Contrast information and image brightness information are examples of image information affected by changes in the PDP driving voltages.

Further, the power supply control data controls a driving voltage of a sustain circuit, a driving voltage of a reset circuit of a scan electrode driving board, a driving voltage of a bias circuit of a common electrode driving board, a voltage of a scan circuit, a voltage of an address circuit, and so on, required by the PDP driving system.

The look-up table may be designed such that various PDP driving voltages corresponding to sensed contrast and brightness values are experimentally obtained to maintain the best possible image quality. Then, values of the power supply control data automatically adjusted by the obtained PDP driving voltages are determined.

The control circuit 430 includes a control unit 430-1 and an analog-to-digital converter (ADC) 430-2. The control unit 430-1 reads from the look-up table 420 power supply control data for controlling the PDP driving voltages corresponding to the respective digital signal values of the sensed contrast and brightness information, and controls the generation of a power supply control signal corresponding to the power supply control data. The power supply control signal is a pulse-width modified signal as shown in FIGS. 5A through 5D.

The sensor 440 senses a contrast level and/or a brightness level of an image, which is displayed on the PDP 450.

Hereinafter, an operation for controlling automatic adjustment of a power supply according to the present invention will be described. After a contrast level and a brightness level of an image displayed on the PDP 450 are sensed by the sensor 440, respective signals of the sensed contrast level and brightness level are converted into digital signals by the ADC 430-2, and the digital signals are input to the control unit 430-1.

The control unit 430-1 reads from the look-up table 420 the power supply control data corresponding to the respective digital signal values displaying the input contrast level and/or the brightness level, and then a pulse width modified power supply control signal is generated to correspond to the read power supply control data as shown in FIGS. 5A through 5D.

The power supply control signal generated in the control unit 430-1 is amplified by the buffer circuit 410-4, which amplifies a push-pull current, and is input to the subtractor circuit 410-2 after passing through the low pass filter 410-3.

The power supply control signal is a pulse-width modification square wave, having a duty (D) which is changed at a regular period. An output voltage of the low pass filter 410-3 is expressed by Equation 2:

$$V_x = DV_{cc} \tag{2}$$

Here, $V_{cc}$ is a supply voltage of the buffer circuit 410-4, and is typically 15V DC. FIGS. 5A through 5D show output voltages $V_X$ of the low pass filter 410-3 according to the power supply control signals, in a case where the power supply control data is 4 bits. It can be seen from FIGS. 5A through 5D that the output voltage $V_X$ has four different patterns, in the case of outputting the power supply control data of 4 bits.

The subtractor circuit 410-2 includes a OP-AMP A42, and outputs a voltage difference signal $V_y$ between a sensing voltage $V_{s,sense}$ of the driving power supply, which is sensed at a point connecting the resistor R41 and the resistor R42 of the voltage sensing circuit R41–R42, and the output voltage $V_x$ of the low pass filter 410-3. The voltage $V_y$ is expressed by Equation 3:

$$V_y \cong \frac{R_{46}}{R_{45}}(V_{s,sense} - V_x) \tag{3}$$

$$V_{s,sense} = \frac{R_{42}}{R_{41} + R_{42}} V_s$$

A function of a capacitor C43 of the subtractor circuit 410-2 is to reduce noise in the sensing voltage $V_{s,sense}$ and the output voltage $V_x$.

In the power supply circuit 400 and the power adjusting circuit 410, since the difference signal voltage $V_y$ follows a reference voltage $V_{ref}$ of the error amplifier A41 though feedback control, Equation 4 is given:

$$V_y = V_{ref} \tag{4}$$

Equations 2 and 3 are substituted for Equation 4 to give Equation 5:

$$V_s = \left(1 + \frac{R_{41}}{R_{42}}\right)\left(DV_{cc} + \frac{R_{45}}{R_{46}}V_{ref}\right) \tag{5}$$

As seen from Equation 5, the PDP driving voltage $V_s$ is varied according to the duty D of the power supply control signal.

As described above, since the power supply control data for maintaining the best possible image quality based on the image state (for example, contrast deviation and brightness deviation) sensed by the sensor 440 is read from the look-up table 420, and the PDP driving voltage is controlled by the pulse-width modified power supply control signal having the duty D corresponding to the read power supply control data, the PDP driving voltage can be automatically controlled to maintain the best possible image quality of the PDP without controlling the power supply using variable resistors as in the prior art.

Next, a method for controlling automatic adjustment of a power supply of a display panel driving system according to the present invention will be described.

First, image information (for example, but not by way of limitation, contrast deviation and/or brightness deviation), which is affected by changes in the driving power supply of the PDP, is sensed by the sensor.

Next, power supply data for controlling a driving power supply of the PDP corresponding to the sensed image information is read from a look-up table.

Then, a pulse-width modified square wave power supply control signal having a duty corresponding to the read power supply control data is generated.

Finally, a display panel driving power supply is controlled according to the pulse-width modified power supply control signal. Specifically, after generating a voltage difference signal between a voltage of the pulse-width modified power supply control signal and a voltage of the sensed the display panel driving power supply, a pulse-width modified flyback switching signal by the voltage difference signal is generated. Thus, the display panel driving power supply circuit is controlled so that the display panel driving voltage is automatically adjusted according to the duty of the power supply control signal.

Figure 1:
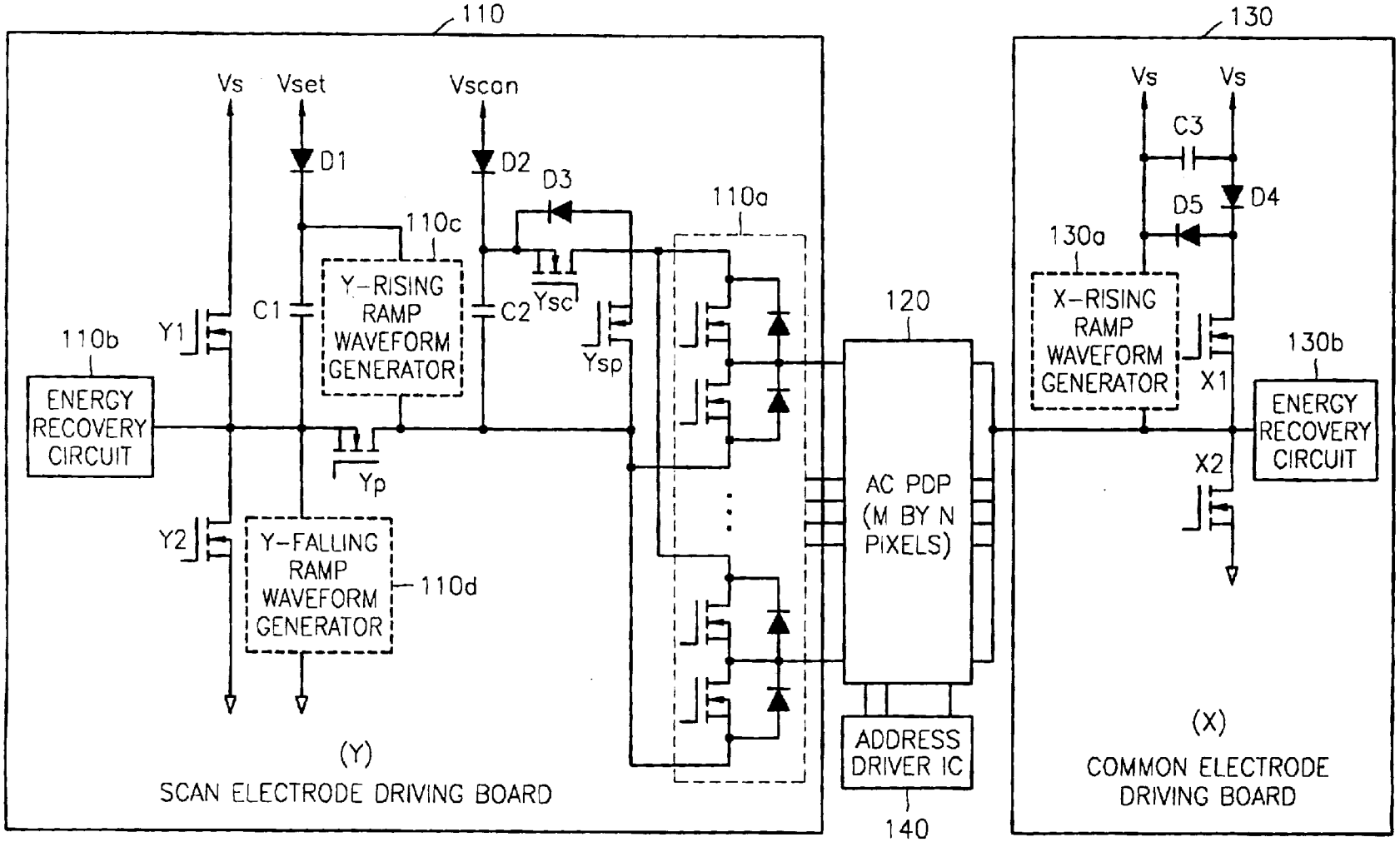
FIG. 1 (PRIOR ART)
FIG. 1 is a configuration view of a related art general plasma display panel driving system.
Figure 2:
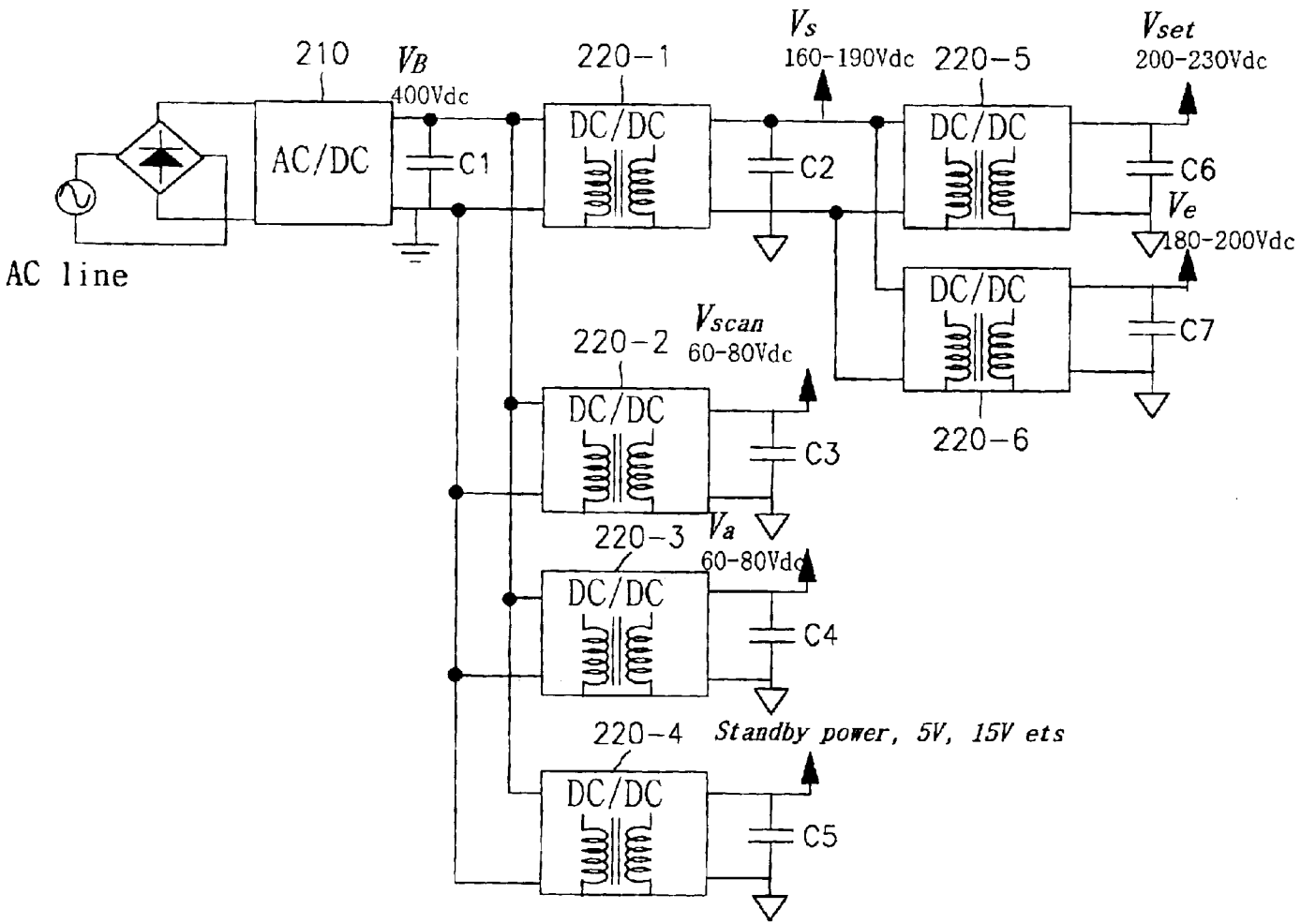
FIG. 2 (PRIOR ART)
FIG. 2 is a configuration view of a related art general power supply circuit for generating a driving voltage of a plasma display panel.
Figure 3:
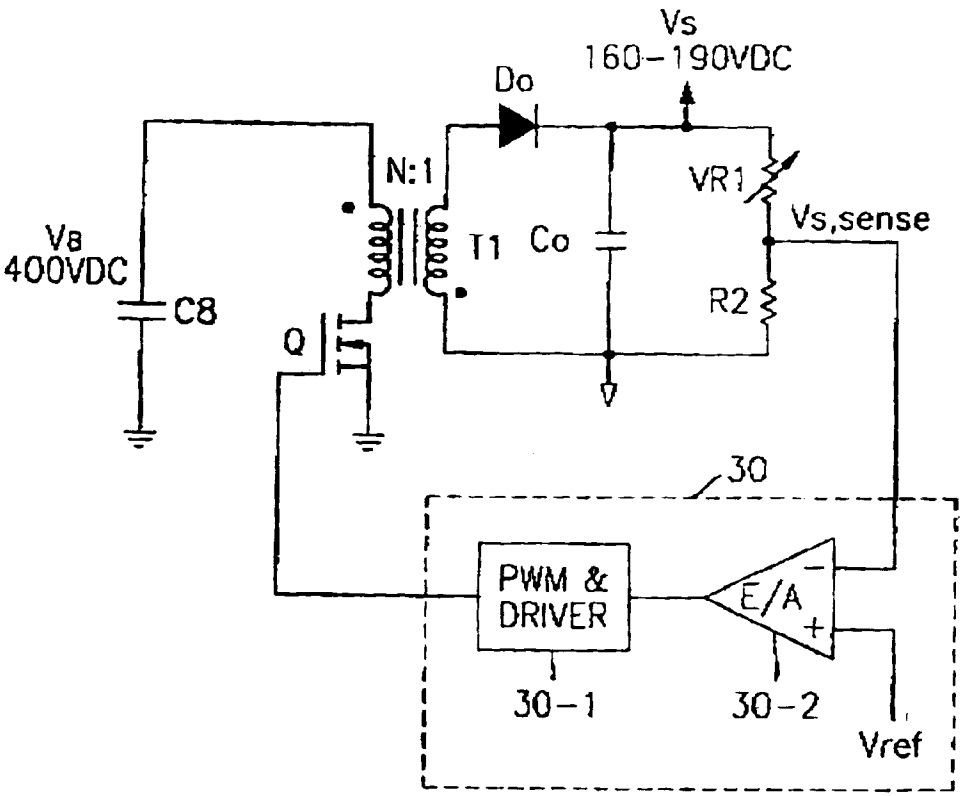
FIG. 3 (PRIOR ART)
FIG. 3 is a configuration view of a related art driving voltage adjusting circuit of a plasma display panel.

Although the embodiment of the present invention has been described using the single panel driving voltage control circuit as shown in FIG. 4, the circuit of FIG. 4 can be applied to the power supply circuit of FIG. 2, which separately controls the automatic adjustment of the respective driving voltages of the PDP.

The present invention can be carried out as a method, apparatus and system, and so on. When the present invention is carried out as software, components of the present invention are code segments carrying out necessary operations. Program or code segments can be stored in processor readable medium, or can be transmitted by a computer data signal coupled with a carrier in a transmission medium or communication network. The processor readable medium includes any medium capable of storing or transmitting information. Examples of processor readable medium includes an electronic circuit, a semiconductor memory device, ROM (read only memory), flash memory, $E^2$PROM (erasable programmable read only memory), a floppy disc, an optical disc, a hard disc, an optical fiber medium and a radio frequency (RF) network. The computer data signal includes any signal capable of propagating on transmission medium such as an electronic network channel, an optical fiber, air, an electromagnetic field, RF network, and the like.

The present invention has various advantages. For example, but not by way of limitation, as described above, the apparatus and method of the present invention have at least the following advantages. Since the PDP driving power supply is not manually adjusted using the variable resistors as in the related art, but is automatically adjusted, the apparatus manufacturing process is simple. Further, deviation caused by the automatic adjustment of the power supply is decreased compared with the manual adjustment of the related art. That advantage is accomplished by automatically adjusting the PDP driving voltage affecting to the contrast deviation and brightness deviation of the PDP image in the PDP driving power supply circuit so as to maintain the best possible image quality.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. An apparatus for controlling automatic adjustment of a power supply of a driving system for a display panel, comprising:

a look-up table that stores power supply control data for controlling a display panel driving power supply corresponding to image information sensed by a sensor from an image signal output by the display panel;

a control circuit that converts the sensed image information into digital data, reads from the look-up table power supply control data corresponding to values of the digital data of the image information, and generates a power supply control signal corresponding to the power supply control data; and a power supply adjusting circuit which automatically varies a voltage supplied to a display panel driving circuit according to the power supply control signal.

2. The apparatus of claim 1, wherein the image information is contrast information.

3. The apparatus of claim 1, wherein the image information is brightness information.

4. The apparatus of claim 1, wherein the display panel is a plasma display panel.

5. The apparatus of claim 1, wherein the power supply control signal is a pulse-width modified signal.

6. The apparatus of claim 1, wherein the display panel driving power supply includes:

a driving voltage of a sustain circuit;

a diving voltage of a reset circuit of a scan electrode driving board;

a driving voltage of a bias circuit of a common electrode diving board;

a voltage of a scan circuit; and a voltage of an address circuit.

7. The apparatus of claim 1, wherein the power supply adjusting circuit includes:

a voltage sensing circuit that senses a diving voltage outputted from a power supply circuit;

a subtractor circuit that generates a difference signal between a voltage sensed in the voltage sensing circuit and a voltage of the power supply control signal; and a flyback circuit that receives the difference signal, generates a pulse-width modified flyback switching control signal, and feeds back the flyback switching control signal to the power supply circuit.

8. The apparatus of claim 7, wherein the power supply adjusting circuit further includes a buffer circuit amplifying the power supply control signal so that the power supply control signal applied to the subtractor circuit is a signal amplified in the buffer circuit.

9. The apparatus of claim 7, wherein the power supply adjusting circuit further includes a buffer circuit amplifying the power supply control signal, and a low pass filter circuit that passes through only a low-frequency signal of an output signal of the buffer circuit, so that the power supply control signal applied to the subtractor circuit is a signal output to the low pass filter circuit.

10. The apparatus of claim 7, wherein two resistors of the voltage sensing circuit are serially coupled between a ground line and an output terminal of the power supply circuit, and a point coupling the two resistors is set as an output terminal of the voltage sensing circuit.

11. The apparatus of claim 7, wherein the subtractor circuit includes an OP-AMP circuit, and the subtractor circuit is noise-filtered according to respective values of a resistor and a capacitor included in the OP-AMP circuit.

12. A method for controlling a power supply of a display panel driving system, comprising:

(a) sensing image information from an image signal output from a display panel by a sensor;

(b) reading power supply control data corresponding to the sensed image information from a look-up table;

(c) generating a pulse-width modified power supply control signal from the read power supply control data; and (d) controlling a display panel driving power supply according to the pulse-width modified power supply control signal.

13. The method of claim 12, wherein said (d) includes:

generating a voltage difference signal between a voltage of the pulse-width modified power supply control signal and the sensed driving voltage; and generating a pulse-width modified flyback switching signal from the difference signal to control the display panel driving power supply circuit.

14. The method of claim 12, wherein the image information is contrast information.

15. The method of claim 12, wherein the image information is brightness information.

16. The method of claim 12, wherein the display panel is a plasma display panel.

17. A computer-readable medium configured to execute instructions for controlling a power supply of a driving system for a display panel, said instructions comprising:

sensing image information from an image signal output from a display panel by a sensor;

reading power supply control data corresponding to the sensed image information from a look-up table;

generating a pulse-width modified power supply control signal from the read power supply control data; and controlling a display panel driving power supply according to the pulse-width modified power supply control signal.

18. The computer readable medium of claim 17, wherein said generating comprises:

generating a voltage difference signal between a voltage of the pulse-width modified power supply control signal and the sensed driving voltage; and generating a pulse-width modified flyback switching signal from the difference signal to control the display panel driving power supply circuit.

19. The computer readable medium of claim 17, wherein the image information is at least one of contrast information and brightness information.

20. The computer readable medium of claim 17, wherein the display panel is a plasma display panel.

21. The apparatus of claim 1, wherein the power supply adjusting circuit includes:

a voltage sensing circuit that senses a driving voltage outputted from a power supply circuit; and a subtractor circuit that generates a difference signal between a voltage sensed in the voltage sensing circuit and a voltage of the power supply control signal; and a first control signal generated from the difference signal, inputted to the power supply circuit.

22. The method of claim 12, wherein said (d) includes:

generating a voltage difference signal between a voltage of the pulse-width modified power supply control signal and the sensed driving voltage; and generating a first control signal from the difference signal and inputting said first control signal to the display panel driving power supply circuit.

23. The computer readable medium of claim 17, wherein said generating comprises:

generating a voltage difference signal between a voltage of the pulse-width modified power supply control signal and the sensed driving voltage; and generating a first control signal from the difference signal and inputting said first control signal to the display panel driving power supply circuit.

* * * * *